US005335907A

United States Patent [19]

Spector

[11] Patent Number: 5,335,907

[45] Date of Patent: Aug. 9, 1994

[54] VARIABLE WEIGHT PLAYBALL

[76] Inventor: Donald Spector, 380 Mountain Rd., Union City, N.J. 07087

[21] Appl. No.: 743,279

[22] Filed: Aug. 9, 1991

Related U.S. Application Data

[63] Continuation-in-part of Ser. No. 345,405, May 1, 1989, Pat. No. 5,138,721, which is a continuation-in-part of Ser. No. 205,477, Jun. 13, 1988, Pat. No. 4,834,382.

[51] Int. Cl.[5] ..... A63B 39/00; A63B 43/00

[52] U.S. Cl. ..... 273/58 H; 273/DIG. 8; 273/DIG. 20

[58] Field of Search ..... 273/58 R, 58 B, 58 BA, 273/58 H, 58 J, 58 A, DIG. 8, DIG. 20, 65 EC, 65 EG

[56] References Cited

U.S. PATENT DOCUMENTS

| | | | |
|---|---|---|---|
| 4,212,460 | 7/1980 | Kraft | 273/58 B |
| 4,463,951 | 8/1984 | Kumasaka et al. | 273/58 BA X |
| 4,660,834 | 4/1987 | Carrigan | 273/58 B X |
| 4,738,450 | 4/1988 | Wexler | 273/58 A |
| 4,772,020 | 9/1988 | Martin | 273/65 EG X |
| 4,834,382 | 5/1989 | Spector | 273/65 EG |
| 4,919,422 | 4/1990 | Ma | 273/65 EG X |
| 4,952,190 | 8/1990 | Tarnoff et al. | 273/58 H X |
| 5,035,425 | 7/1991 | Edwards | 273/58 J X |
| 5,035,426 | 7/1991 | Spector | 273/65 EG X |
| 5,138,721 | 8/1992 | Spector | 2/267 |

FOREIGN PATENT DOCUMENTS

| | | | |
|---|---|---|---|
| 390690 | 4/1933 | United Kingdom | 273/65 EC |

*Primary Examiner*—William H. Grieb
*Attorney, Agent, or Firm*—Michael Ebert

[57] ABSTRACT

A variable-weight playball whose outer casing is formed of liquid-impervious, non-stretchable, flexible material, such as a resin-coated fabric, the casing being provided with a closable port. Confined within the casing is a compressible body having the same configuration which depends on whether the ball is of the spherical type or in some other shape. The body is formed of low-density, open-cell, flexible foam plastic material having sponge-like properties. To impart heft to the ball, water is introduced through the port into the body and absorbed thereby, the port then being closed to retain the water. To thereafter lighten the ball, the port is opened and the ball is squeezed to discharge water through the port until the ball has the desired reduced weight, after which the port is closed. The weight selected depends on the use to which the ball is put.

7 Claims, 1 Drawing Sheet

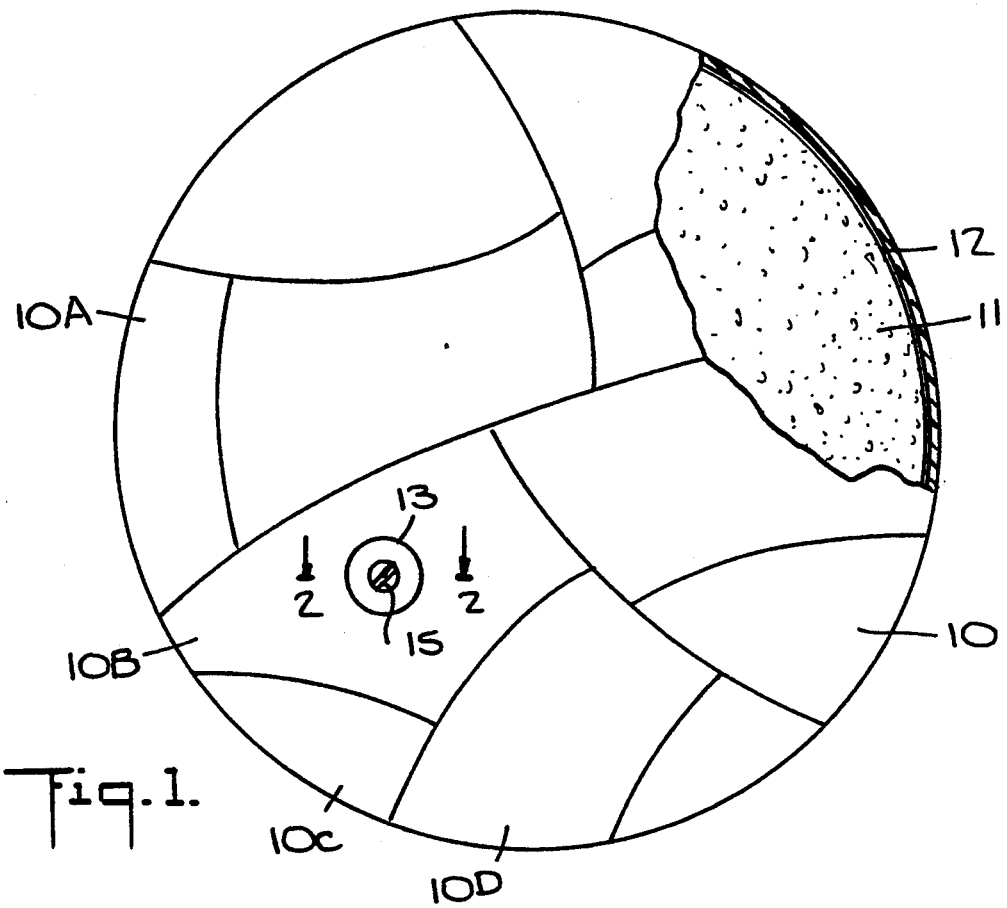
Fig. 1.
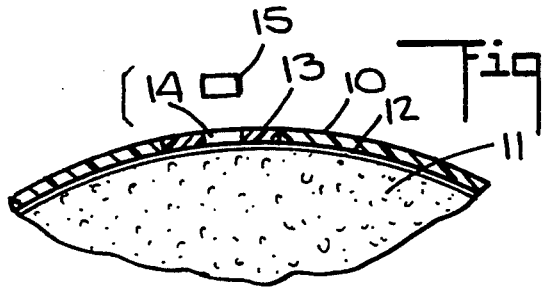
Fig. 2.
Fig. 3.
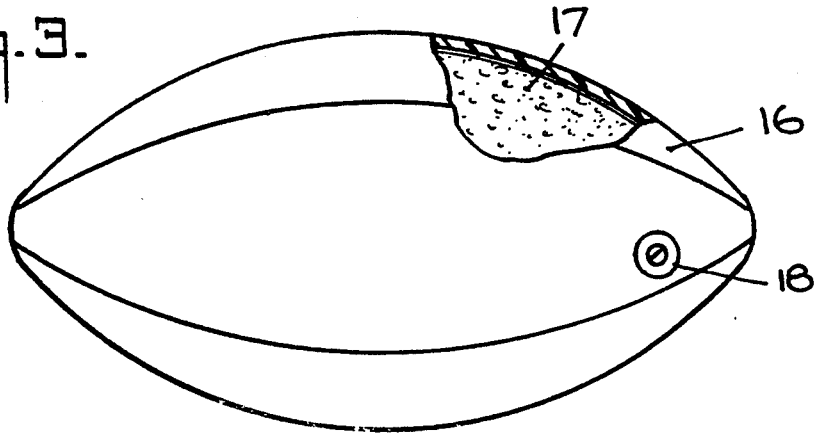

VARIABLE WEIGHT PLAYBALL

RELATED APPLICATION

This application is a continuation-in-part of my copending application Ser. No. 345,405, filed May 1, 1989, entitled "Pneumatic Bolster," (now U.S. Pat. No. 5,138,721) this being a continuation-in-part of a still earlier patent application Ser. No. 205,477, filed Jun. 13, 1988, entitled "Inflatable Play Ball" (now U.S. Pat. No. 4,834,382). The entire disclosures of these prior applications are incorporated herein by reference.

BACKGROUND OF INVENTION

1. Field of Invention

This invention relates generally to playballs, and more particularly to a variable-weight play ball having an encased sponge-like body within which water is dispersed to impart a desired degree of heft to the ball.

2. Status of Prior Art

A standard football is of oval shape and is made of an inflatable, high strength inner bladder and an outer casing formed of heavy leather, rubber or flexible plastic material. The bladder is provided with a valve so that it can be inflated with air, the valve automatically closing to retain the air in the bladder. Made in a similar fashion are spherical soccer balls, volley balls and basketballs. In these standard balls, the bladder is molded to assume, when inflated, the same shape as the outer casing.

In the process of play, standard sports play balls of the pneumatic type are tossed, kicked and bounced, the balls being capable of withstanding very rough handling. While such balls are not regarded by adults as unduly heavy, they represent an intolerable load to a young child. Moreover, a standard inflatable athletic ball tends to produce a "hand sting." This effect arises when the ball which has a hard casing is caught by the bare hands while moving at high velocity.

While small children are attracted to conventional athletic balls and enjoy watching adults play soccer, football and other ball games, in the hands of a small child these athletic balls are heavy and dangerous, especially in indoor play. The standard inflated athletic ball has a relatively large diameter and a smooth, hard outer casing which makes it very difficult for a small child to grasp, throw and catch.

The toy and game industry has long recognized the need for lighter, softer and potentially less dangerous balls for young children. Thus, balls in various shapes and sizes are now commercially available which are molded of polyurethane foam material and other lightweight compressible plastics. Thus the patent to Martin, U.S. Pat. No. 4,772,020, discloses a football intended for children in the form of a one-piece molded elliptical body constituted by soft, light-weight elastomeric foam material, such as polyurethane foam. And the patent to Ma, U.S. Pat. No. 4,919,422, discloses a spherical ball of baseball size formed of flexible foam plastic material.

While such foam plastic balls are safe in the hands of pre-school children and will inflict no harm even if the ball is hurled toward the body of another child, they fail in many respects to satisfy the typical child's desire for a ball that looks like a real athletic ball of the type used by adults, and can be kicked, thrown or bounced like a regulation ball.

Moreover, light-weight balls made of flexible foam plastic material, though much softer in the hands of children than the regulation balls they imitate, are incapable of withstanding rough handling. Thus a foam plastic spherical ball having a diameter equivalent to that of a regulation soccer ball, though it can be thrown and bounced, cannot long survive being vigorously kicked by players.

In my above-identified prior patent application, I disclose a pneumatic playball that has a configuration and appearance of a standard pneumatic athletic ball such as a football or basketball, yet it is much lighter, and therefore when in the hands of young children, it is far safer to play with. And despite its light weight, the ball is exceptionally strong and can withstand rough handling.

My prior patent U.S Pat. No. 4,834,382 discloses a pneumatic play ball that includes an outer casing of non-stretchable fabric material having a closable opening therein, the configuration of the casing depending on the nature of the ball. The casing encases an ordinary balloon of stretchable material which when unconfined is capable of being inflated to assume a generally globular form, the balloon having an air-passage stem. In its uninflated state, the balloon is inserted into the casing through the opening, the stem then projecting out of the opening.

After the confined balloon is inflated by blowing air through its stem to cause the balloon to conform to the inner surface of the casing and to assume the same configuration, the stem is knotted to seal the balloon. The knotted stem is pushed under the opening which is then closed, whereby no portion of the encased balloon can be extruded from the casing when the ball bounces.

As pointed out in my prior patent U.S. Pat. No. 5,035,426, a fabric-encased balloon, while not nearly as heavy as a leather encased conventional pneumatic ball, has sufficient weight to permit easy throwing without, however, inflicting injury should the ball hit a child. However, in some circumstances, the ball may be too light to permit play. Thus on a windy beach, wind gusts will often deflect the fabric-encased balloon and interfere with play activity. In order, therefore, to give greater weight to the ball, this patent suggests that this can be done by wetting the outer fabric casing.

Wetting the fabric will add some weight to the ball, but since the fabric of the outer casing is exposed, it will not remain wet for long because of evaporation from this surface. Moreover, as it is only the outer surface of the ball that is water laden, the amount of weight added to the ball may not be sufficient for certain types of play activity.

Where the ball is of basketball size or greater and is to be tossed about in the fashion of a medicine ball, it is then desirable that the ball have considerable heft. Or where the ball is of soccer ball size and is to be played with by older children, it is desirable that its weight be closer to that of a regulation soccer ball, so that when kicked it will behave like a regulation ball. These ends cannot be achieved with my prior pneumatic encased balloon ball, which is inherently light in weight.

SUMMARY OF INVENTION

In view of the foregoing, the main object of this invention is to provide a compressible play ball having any desired ball configuration, the body of the ball being formed of low-density, flexible foam plastic open-cell material and being confined within a casing of non-stretchable material to create a ball of exceptional strength capable of withstanding rough handling.

A significant advantage of a ball in accordance with the invention is that a large percentage of its low-density, foam-plastic body is constituted by air; hence the ball in its initial state is not much heavier than an encased balloon playball of my prior type. However, by adding water to the body which is absorbed thereby, the heft of the play ball may be increased to a desired degree.

More particularly an object of this invention is to provide a play ball of the above type whose outer casing is liquid-impervious and includes a small closable port, and whose foam plastic body has sponge-like characteristics whereby water can be introduced into the body through its open port and absorbed thereby to impart heft to the body, the water being thereafter extrudable through the port to reduce the water content of the body and thereby lighten the ball.

Also an object of this invention is to provide a durable, high-strength ball of the above type which may be manufactured at low cost.

Briefly stated, these objects are attained in a variable-weight playball whose outer casing is formed of liquid-impervious, non-stretchable, flexible material, such as a resin-coated fabric, the casing being provided with a closable port. Confined within the casing is a compressible body having the same configuration which depends on whether the ball is of the spherical type or in some other shape. The body is formed of low-density, open-cell, flexible foam plastic material having sponge-like properties. To impart heft to the ball, water is introduced through the port into the body and absorbed thereby, the port then being closed to retain the water. To thereafter lighten the ball, the port is opened and the ball is squeezed to discharge water through the port until the ball has the desired reduced weight, after which the port is closed. The weight selected depends on the use to which the ball is put.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of one preferred embodiment of a playball in accordance with the invention, the outer casing being partially cut away to expose the inner foam-plastic body of the ball;

FIG. 2 is a section taken in the plane indicated by line 2—2 in FIG. 1; and

FIG. 3 shows another embodiment of the play ball.

DESCRIPTION OF INVENTION

Referring now to FIG. 1, there is illustrated a variable-weight playball in accordance with the invention, the ball being spherical and having a diameter corresponding to that of a regulation basketball or soccer ball. In practice the ball may have a larger or smaller diameter. The ball is constituted by an outer casing 10 having a spherical shape within which is confined a compressible body 11 whose shape conforms to that of the casing so that no space exists therebetween.

Casing 10 is created by interfitting pieces 10A, 10B, 10C, 10D, etc., of non-stretchable fabric sheeting sewn together by filamentary thread lines which are not visible on the outer surface of the casing. If the fabric is made of thermoplastic synthetic fibers, the pieces may be ultrasonically seamed together to render them watertight at the seams. A preferred fabric for this purpose is parachute cloth, which is a high-strength, light-weight, closely woven fabric made of nylon fibers. Other types of non-stretchable fabrics, such as GORE-TEX, may be used for the casing material.

Sealed to fabric piece 10B of casing 10 or to any other piece thereof, is a flexible disc 13 formed of thermoplastic material, such as polypropylene, provided at its center with a small port 14 that is internally-threaded. As shown in FIG. 2, threadably received in port 14 is a removable plug 15 to provide access to body 11 of the ball. Plug 15 is provided with a diametrical slot so that it can be turned in or out by a small coin or a screwdriver.

While a small port is necessary to the playball, the closure therefore need not be in the form of a screw-in plug, for in practice use may be made of a press-in plug or other closure means.

Laminated or otherwise applied to the inner surface of casing 10 to render it waterproof is a film 12 of liquid-impervious material. Film 12 may be created by a resinous coating applied in a molten state to the fabric of the casing, the coating impregnating the fibers of the fabric to both reinforce the fabric and render it impervious to water. Or when the casing fabric is thermoplastic in nature, a PVC or other thermoplastic film may be laminated to the fabric material by heat and pressure. One could produce a casing of non-stretchable, flexible, waterproof material using a high-strength plastic film for this purpose. But the advantage of a fabric casing is that its outer surface is not smooth and the ball is therefore more easily gripped by a child.

Body 11 is formed of low-density, open-cell flexible foam plastic material which is highly compressible and has sponge-like characteristics Foam plastics range in density from one tenth of a pound to 65 pounds per cubic foot, and range in consistency from rigid materials suitable for structural applications, to flexible substances for soft cushions. And they range in cellular formation from open or interconnecting cells to the closed or unicell type. A preferred form of plastic material for body 11 is one in which gas is generated chemically during the reactions that that take place in forming the open-cell plastic, such as polyurethane foam. In producing this foam, a polyester resin and an aromatic diisocyanate react to form a prepolymer which then reacts with water to form a urethane polymer. Because of the carbon dioxide generated in this reaction, its presence causes the urethane resin to assume an interconnected open cell foam.

Foam plastic body 11 is of a low density, preferably not exceeding one and one half pounds per cubic foot. Hence the ball, in its initial state, is relatively light in weight, for a large percentage of the body is constituted by the air which fills the cells.

In manufacturing this ball, the casing may be used as a mold for the foam plastic body which is created by pressure feeding the foam plastic in its molten state into the interior of the casing through open port 14 until the entire interior is filled with the molten mass.

When the mass is coated and cured, the resultant body which conforms to the shape of the casing is constituted by flexible, open-cell foam plastic material. At the interface of the outer surface of the molten mass and the interior surface of the casing a pore-free plastic skin is formed which fuses to the fabric casing to waterproof the casing and thereby obviate the need for a waterproofing film. However, this film is useful, for it also functions to reinforce the fabric casing.

In order to impart a desired degree of heft to the ball, water is added to its sponge-like body to be absorbed thereby, the water being distributed throughout the body, so that it is properly balanced. To this end, plug 15 is removed to open port 14, and the ball is compressed by hand to expel air out of the sponge-like body, the air being discharged through the open port. Water is then fed through the port into the body, and as this is done, the hand pressure on the ball is gradually released to create a negative pressure within the sponge-like body. This acts to soak up the water and to distribute it uniformly throughout the body. One adds as much water as is necessary to bring up the weight of the ball to the desired level, at which point the port is closed to retain the water within the ball.

Should a player later wish to somewhat lighten the playball, this is easily accomplished by again opening the port and squeezing the ball to extrude water from the sponge-like body out of the port until the ball attains the desired reduced weight.

When the playball is vigorously kicked or bounced, the shock is absorbed by the compressible body of the ball, but the shape of the ball is maintained by the non-stretchable fabric casing which permits indentation of the ball in the region at which the force is applied, but does not permit the ball to assume any shape than its predetermined spherical configuration.

The invention is by no means limited to balls having a spherical shape. As shown in FIG. 3, the ball may be in a football format, in which case it is constituted by a non-stretchable fabric casing 16 which is waterproof and is made in the same manner as casing 10 in FIG. 1, and an open-cell, flexible, foam-plastic body 17 confined within the casing, both the casing and body having an oval football configuration. Sealed to casing 16 is a flexible disc 18 provided with a closable port, as in FIG. 1, to permit the water to be added to or extracted from body 17.

While there have been shown and described preferred embodiments of a variable-weight playball in accordance with the invention, it will be appreciated that many changes and modifications may be made therein without, however, departing from the essential spirit thereof. It is not essential that the casing be non-stretchable, as long as it confines the foam-plastic body encased therein. Thus the casing may be made of a somewhat stretchable neoprene or plastic material.

A preferred way of making the variable weight playball is to make use of a fabric outer casing of the type disclosed in my prior balloon ball patents, and inserting through the port of this casing a conventional inflatable beach ball having a liquid-impervious flexible plastic skin of PVC or similar synthetic-plastic film material, the beach ball having a closable air inlet.

The beach ball is inserted into the casing through the port thereof in its collapsed state with its air inlet aligned with the port of the fabric casing. The configuration and dimensions of the beach ball match those of the casing within which it is confined. However, instead of inflating the beach ball with air, injected into the air inlet of the beach ball through the port of the casing is molten foam plastic material of the open-cell type, the molten plastic filling the beach ball so that its plastic skin is caused to conform to the inner surface of the fabric casing. When the molten plastic cools and cures, this creates the foam plastic body of the playball which can then be impregnated with water in the manner disclosed previously to an extent imparting the desired heft to the playball. The closure on the air inlet is used to retain this water within the body.

In this arrangement, the foam-plastic body of the playball is confined within a waterproof plastic skin which conforms to the inner surface of the fabric casing. The combination of the beach ball skin and fabric casing creates a liquid-impervious outer casing to prevent leakage of water from the playball.

I claim:

1. A variable weight squeezable playball in which the weight of the ball is determined by a user, said ball comprising:

(a) an outer casing formed of liquid-impervious, flexible material having a configuration that depends on the nature of the playball;

(b) a low-density compressible body normally having the same configuration as the casing and confined within the casing, the body being formed of flexible foam plastic material having sponge-like characteristics; and (c) a port formed in the casing to provide access to the body encased therein and a removable closure for said port, said port being reopenable by the user whereby water may be introduced through the port into the body when the playball is squeezed by by the user, the water being absorbed by the body as the body resumes its normal configuration to impart heft to the playball, after which the port is closed by the closure to retain the water and the playball is then in condition for play, and should it be thereafter necessary to lighten the ball, the port may then be opened and the ball squeezed to extrude water from the body until the ball has the desired reduced weight, said casing being formed of a fabric material whose inner surface is resin coated to render the fabric waterproof.

2. A playball as set forth in claim 1, wherein said configuration has a spherical form.

3. A playball as set forth in claim 1, wherein said configuration has an elliptical form.

4. A playball as set forth in claim 1, in which said body is formed of open-cell, flexible-foam, synthetic plastic material.

5. A playball as set forth in claim 4, wherein said foam material is polyurethane.

6. A playball as set forth in claim 1, wherein said port is formed in a disc sealed to said ball, and the closure therefor is a plug received in said port.

7. A variable weight squeezable playball in which the weight of the ball is determined by a user, said ball comprising:

(a) an outer casing formed of liquid-impervious, flexible material having a configuration that depends on the nature of the playball;

(b) a low-density compressible body normally having the same configuration as the casing and confined within the casing, the body being formed of flexible foam plastic material having sponge-like characteristics; and (c) a port formed in the casing to provide access to the body encased therein and a removable closure for said port, said port being reopenable by the user whereby water may be introduced through the port into the body when the playball is squeezed by the user, the water being absorbed by the body as the body resumes its normal configuration to impart heft to the playball, after which the port is closed by the closure to retain the water and the playball is then in condition for play, and should it be thereafter necessary to lighten the ball, the port may then be opened and the ball squeezed to extrude water from the body until the ball has the desired reduced weight, said casing being formed of a fabric material to whose inner surface is laminated a film of thermoplastic material to render the fabric waterproof.

* * * * *